US008591239B2

(12) United States Patent
Dai et al.

(10) Patent No.: US 8,591,239 B2
(45) Date of Patent: Nov. 26, 2013

(54) MULTI-CONTACT CONNECTOR SYSTEM

(75) Inventors: William A. Dai, Arcadia, CA (US); George Tziviskos, San Jose, CA (US)

(73) Assignee: Advanced Bionics AG, Staefa (CH)

( * ) Notice: Subject to any disclaimer, the term of this patent is extended or adjusted under 35 U.S.C. 154(b) by 128 days.

(21) Appl. No.: 13/318,139

(22) PCT Filed: May 4, 2010

(86) PCT No.: PCT/US2010/033574
§ 371 (c)(1),
(2), (4) Date: Oct. 29, 2011

(87) PCT Pub. No.: WO2010/129568
PCT Pub. Date: Nov. 11, 2010

(65) Prior Publication Data

US 2012/0045912 A1 Feb. 23, 2012

Related U.S. Application Data

(60) Provisional application No. 61/175,451, filed on May 4, 2009.

(51) Int. Cl.
*H01R 13/44* (2006.01)

(52) U.S. Cl.
USPC ..... 439/133

(58) Field of Classification Search
USPC ..... 439/133, 299, 372
See application file for complete search history.

(56) References Cited

U.S. PATENT DOCUMENTS

| | | | | |
|---|---|---|---|---|
| 5,916,002 | A * | 6/1999 | Gottschalk et al. | 439/839 |
| 7,521,292 | B2 | 4/2009 | Rogers et al. | |
| 7,557,367 | B2 | 7/2009 | Rogers et al. | |
| 7,622,367 | B1 | 11/2009 | Nuzzo et al. | |
| 2002/0181728 | A1 * | 12/2002 | Connors et al. | 381/381 |
| 2004/0132337 | A1 | 7/2004 | Plishner | |
| 2008/0299815 | A1 | 12/2008 | Schlumpf | |
| 2009/0136069 | A1 * | 5/2009 | Heerlein et al. | 381/323 |
| 2009/0317639 | A1 | 12/2009 | Axisa et al. | |
| 2009/0318003 | A1 * | 12/2009 | Hossack et al. | 439/299 |
| 2010/0002402 | A1 | 1/2010 | Rogers et al. | |
| 2010/0059863 | A1 | 3/2010 | Rogers et al. | |

OTHER PUBLICATIONS

PCT International Search Report and Written Opinion dated Aug. 16, 2010.

* cited by examiner

*Primary Examiner* — Renee Luebke
*Assistant Examiner* — Larisa Tsukerman
(74) *Attorney, Agent, or Firm* — Henricks, Slavin & Holmes LLP

(57) ABSTRACT

A connector system for Behind-The-Ear (BTE) hearing devices provides a means to detachably connect a variety of accessories to a sound processor, including batteries, earhooks, telecoils, auxiliary microphones, FM receivers, and input jacks for miscellaneous devices. The present invention provides an efficient and economical sealing connection, eliminating the introduction of sweat, body fluid and other contaminants into the connection area, which otherwise would result in corrosion and eventually disable the connected device. A wiping contact formed by a configuration of cam contacts and a flex circuit with a configuration of corresponding contacts is combined with a rotational engagement mechanism to create a vibration-resistant high contact density connector that is moisture proof when engaged.

22 Claims, 14 Drawing Sheets

MULTI-CONTACT CONNECTOR SYSTEM

RELATED APPLICATIONS

The present application is a national stage application under 35 U.S.C. 371 of International Application No. PCT/US10/33574, filed May 4, 2010, which in turn claims priority to U.S. Provisional Patent Application No. 61/175,451 by William Dai et al., filed on May 4, 2009, and entitled "MULTI-CONTACT CONNECTOR SYSTEM," the contents of which are hereby incorporated by reference in their entirety.

BACKGROUND OF INVENTION

The present invention relates to hearing devices for aiding the hearing impaired and the profoundly deaf, and more particularly to a multi-contact connector system providing electrical and mechanical connection between an external sound processor and a battery, earhook, or other accessory desired to attach to the sound processor. The connector system of the present invention is useful for conventional hearing aids and for cochlear stimulation systems employing Behind-The-Ear (BTE) and body worn sound processors, and for other devices requiring a mechanically stable and robust sealing connector having multiple contacts.

Implantable Cochlear Stimulation (ICS) systems are known in the art. Such systems are used to help the profoundly deaf to hear. The sensation of hearing is achieved by directly exciting the auditory nerve with controlled impulses of electrical current, which impulses are generated as a function of audio sounds picked up by a microphone carried externally by the deaf person and converted to electrical signals. The electrical signals, in turn, are processed by a sound processor, e.g., converted to a sequence of pulses of varying width and/or amplitude, and then transmitted to an implanted receiver circuit of the ICS system. The implanted receiver circuit then generates electrical current as a function of the processed signal it receives from the sound processor. The implanted receiver circuit is connected to an implantable electrode array that has been inserted into the cochlea of the inner ear. The electrical current generated by the implanted receiver circuit is applied to individual electrode pairs of the electrode array to stimulate the auditory nerve and provide the user with the sensation of hearing.

The sound processor is powered by batteries that typically have a limited life before they need to be recharged or replaced. These devices are often worn by children and the elderly, and the batteries may be detached and reattached by the patient one to several times a day. Therefore, their battery connection must be both easy to work and robust. In addition to batteries, users of hearing aids and cochlear implants have requirements to attach a variety of auxiliary devices to the sound processor to augment the basic hearing function. These devices include earhooks, telecoils, auxiliary microphones, FM receivers, audio jacks, and the like, and they may be attached and detached as needed for various activities throughout the day. Many of these devices are capable of transmitting and/or receiving information, which may be analog or digital.

ICS systems typically include an external headpiece positioned on the side of the user's head for communicating with the cochlear implant and connected to the sound processor via an external cable. While some sound processors are carried by the user on a belt or in a pocket, others are worn behind the ear (BTE), greatly increasing the exposure to sweat. A particular problem associated with cochlear stimulators and related medical devices is corrosion. When sweat, bodily fluids, and other contaminants come in contact with the battery terminal or an accessory's electrical contacts, corrosion occurs, which, left unchecked, would eventually disable the system, or at least disable the accessory. The integrity of the connection between the battery or other accessory and the sound processor is critical for proper function and safety. The connection must prevent the introduction of foreign matter, such as body fluids and other contaminants that may compromise the electrical connection. An effective, efficient solution is needed for this problem.

Another problem is medical device stability and ability to withstand vibration. The battery or accessory must be firmly connected to the sound processor in such a way as to avoid disconnection resulting in medical device malfunction leading to loss of hearing. Thus, in addition to ensuring a complete seal of the connection area between a battery or accessory and a medical device, the connection must also be mechanically sound.

As such, it is desirable to have a device that provides a simple, easy-to-use, inexpensive, reliable, robust connection and sealing mechanism and that efficiently and effectively addresses the problems found in the prior art. There is therefore a need to provide a small, lightweight means to reliably and detachably connect a battery, earhook, or other auxiliary device to a BTE sound processor.

SUMMARY OF THE INVENTION

The present invention addresses the above and other needs by combining a wiping contact with a rotational engagement mechanism to create a vibration-resistant high contact density connector that is moisture proof when engaged. The multi-contact connector system serves as an electrical and mechanical attachment system for batteries, earhooks, and other accessories to a Behind-The-Ear (BTE) or body worn hearing device, such as telecoils, auxiliary microphones, FM receivers, and audio jacks, as part of either a hearing aid system or of a cochlear stimulation system.

The connector mechanism resembles a cam (male side) and cam follower (female side) mechanism. As used herein, the term "cam" means a curved wedge movable about an axis, which may be an axis of the cam itself or of a first connector of which it is a part, which forces contacts of the first connector against contacts of a second connector during rotation about the axis. In one embodiment, the cam comprises fixed metal contacts, creating a high density contact device with key and locking features. In one embodiment, the cam follower comprises a flex circuit held in tension around the perimeter of the cam. Both ends of the flex circuit are fixed to the connector housing and held in tension with a spring, such as an elastomeric spring. When the first connector and the second connector are rotated relative to each other about a mutual axis, the tension provided by the spring forces electrical contact between the cam and cam follower contacts throughout a customizable range of rotational movement. By not using the electrical contact itself to supply the spring force to maintain contact, the problem of fatigue in connectors known in the art can be eliminated. The customizable range of rotational movement can be designed to vary the self cleaning action of the wiping contacts. Instead of only adjusting wiping force to improve the self cleaning action, the connector designer may design the rotational range to increase the effective length of the wipe. The customizable range of rotation also increases design flexibility and/or reliability of the connection during vibration, since the first and second connectors may be allowed to rotate and maintain function during vibration about the axis.

The connector structure provides greater contact area than other contact designs, thereby increasing reliability. The compact size of the connector allows a size reduction of external hardware, increasing the aesthetic appeal and reducing weight. The compact size and contact density of the connector improve diagnostic tool usability, allowing analog and digital data streams to travel over one connection instead of through multiple cables.

A male connector and a female connector together provide the necessary mechanical stability. A strategically positioned sealing ring ensures a complete seal from the external environment.

Furthermore, the robust design is easily and efficiently manufactured at low cost with regard to both materials and labor.

The connector is easy to use by simply plugging the male connector into the female connector and twisting to make contact and lock.

BRIEF DESCRIPTION OF DRAWINGS

Throughout the drawings, identical reference numbers designate similar, but not necessarily identical, elements.

DETAILED DESCRIPTION OF INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
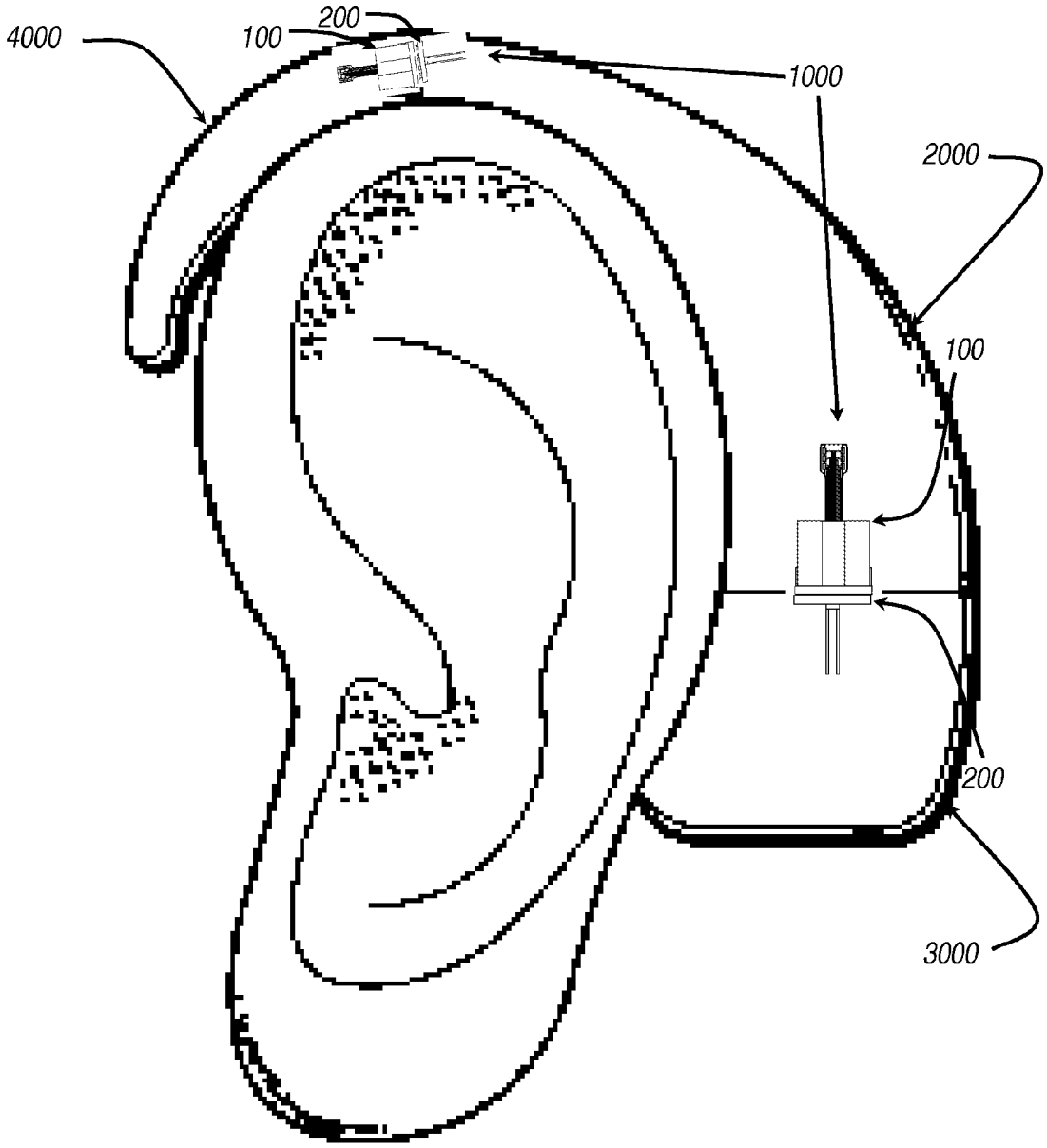
FIG. 1 shows a BTE hearing device utilizing the multi-contact connector system of the present invention.

FIG. 1 shows a Behind-The-Ear (BTE) sound processor 2000 utilizing the multi-contact connector system 1000 of the present invention to provide a mechanical and electrical connection for a battery 3000 and for an earhook 4000. The earhook 4000 is arched and hooks in front of the ear, and is removably attached to the BTE sound processor 2000. The BTE sound processor 2000 continues the arch and is positioned behind the ear. The battery 3000 is removably attached to the bottom of the BTE sound processor 2000. Various batteries of different sizes may be interchangeably attached to the BTE sound processor, depending upon the needs of a user. Likewise, various earhooks having different functionality or size may be interchangeably attached to the BTE sound processor, again, depending upon the needs of the user.

The BTE sound processor 2000 is small and fits compactly behind the user's ear, and as a result, there is limited surface area available for connectors. The battery 3000 connects with the BTE sound processor 2000 via the insertion of the male connector 200 into the female connector 100 of the multi-contact connector system 1000, providing mechanical stability for the assembled sound processor and battery, while wiping contacts provide the electrical connection that powers the implanted cochlear stimulator (not shown). Although the female connector 100 is illustrated as being on the sound processor 2000 and the male connector 200 is illustrated as being on the battery 3000, these features may also be reversed. Likewise, although the female connector 100 is illustrated as being on the earhook 4000 mated to the male connector 200 on the BTE sound processor 2000, this can also be reversed.

Figure 2:
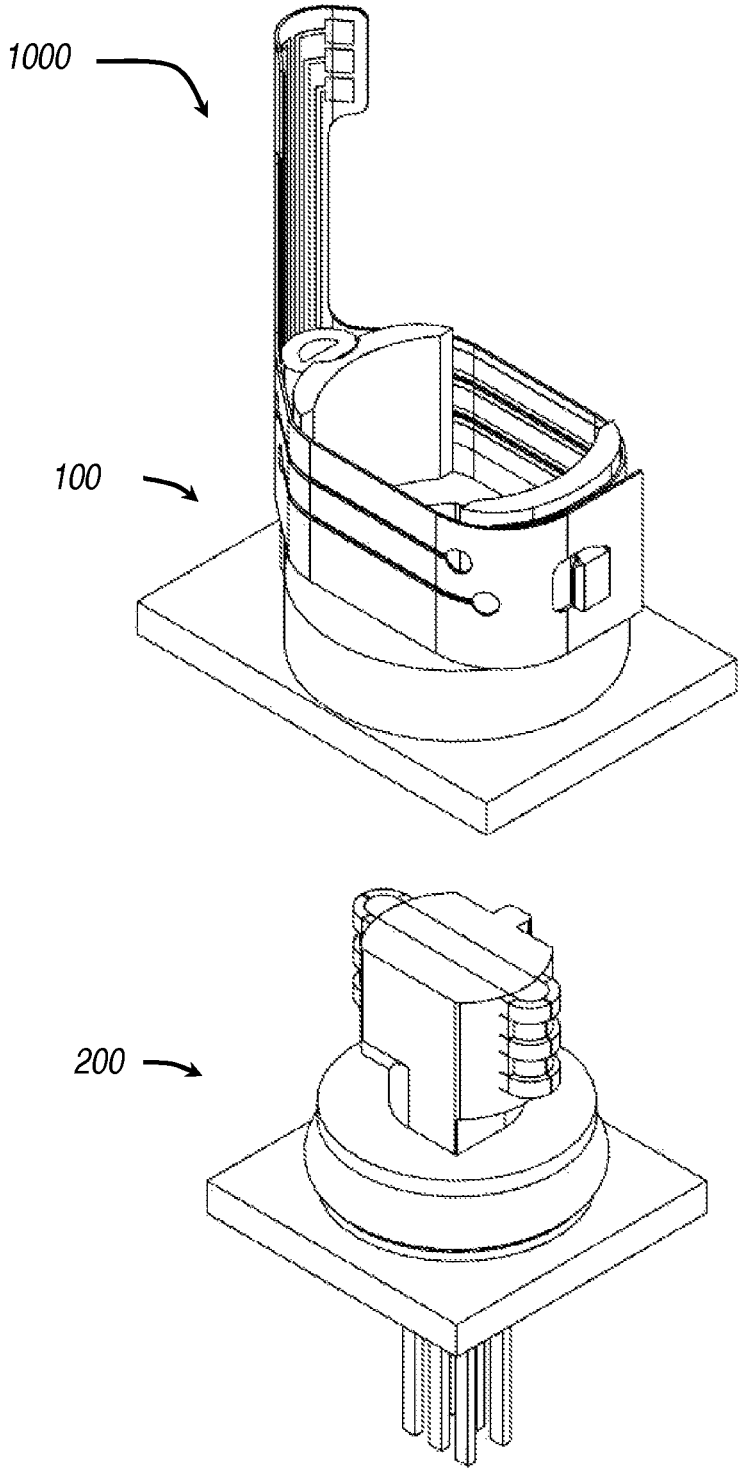
FIG. 2 shows a multi-contact connector system made in accordance with the present invention.

FIG. 2 shows a multi-contact connector system 1000 made in accordance with the present invention ready for engagement of the female connector 100 with the male connector 200. (The moisture barrier cap 120, shown in FIG. 4, has been removed to show detail.)

Figure 3:
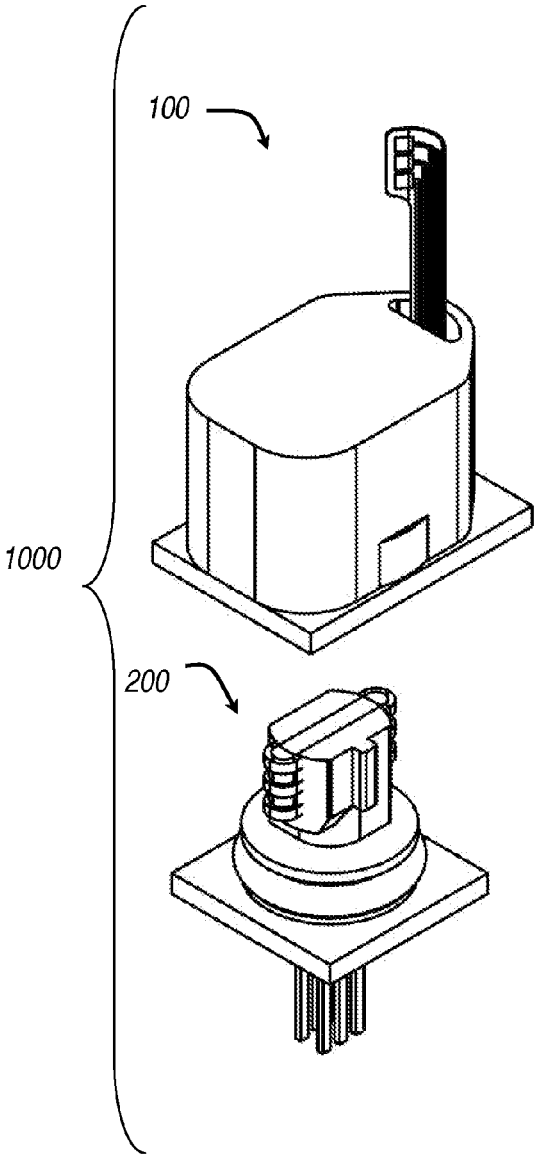
FIG. 3 shows the male connector and female connector of the multi-contact connector system.

FIG. 3 shows the female connector 100 and male connector 200 of the multi-contact connector system 1000. Although not shown, a cover for either the female or male connector or both may be provided to keep them clean when not in use.

Figure 4:
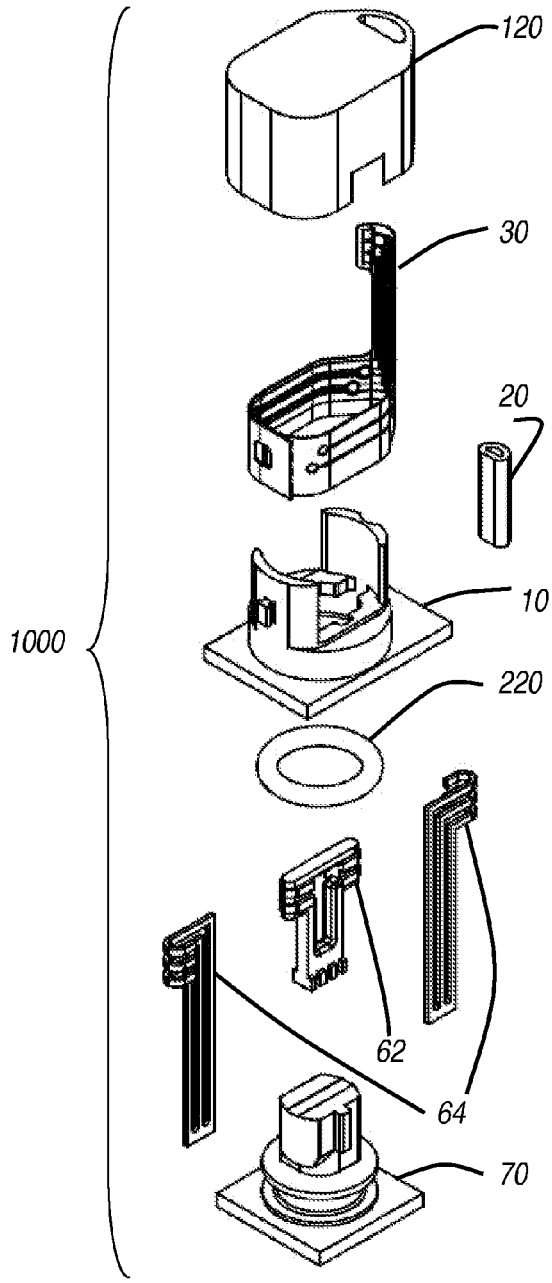
FIG. 4 shows an exploded view of the components of the multi-contact connector system.

FIG. 4 shows an exploded view of the components of the multi-contact connector system 1000, including a moisture barrier cap 120, a flex circuit 30, a spring 20, a flex circuit mount 10, a sealing ring 220, cam contacts 64, a contact carrier 62, and an overmold 70. Assembly of these components will be described below.

Figure 5:
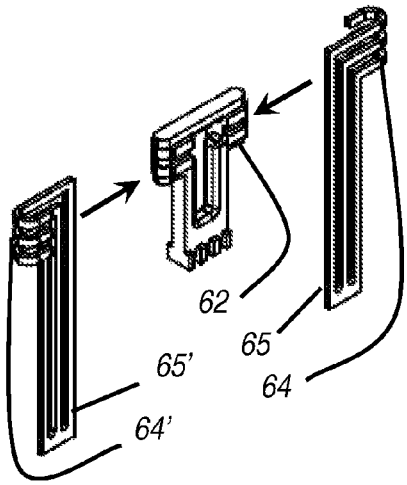
FIG. 5 shows assembly of the cam contacts to the contact carrier to form a male contact assembly of a multi-contact connector system.

FIGS. 5-8 illustrate assembly of the male connector 200. As shown in FIG. 5, cam contacts 64 are placed onto a contact carrier 62 to form a male contact assembly 60, shown in FIG.

6. Cam contacts 64 can be machined, stamped, laser cut, or otherwise manufactured using other precision forming processes. In one arrangement, a copper beryllium base is plated with 100 microinch nickel plating, and covered with a 10 microinch layer of hard gold. In one illustrative embodiment, the contacts 64 may have a width of about 0.020 inches with a separation between them of about 0.015 inches, creating a compact, high contact density connector. Contact carrier 62 can be machined or molded using various plastics forming processes. In one illustrative embodiment, contact carrier 62 is made of a high strength, moderate stiffness plastic, such as Ultem® 1000 polyetherimide thermoplastic, which is a biocompatible engineering plastic available from Sabic Innovative Plastics. In all components described herein as made of plastic, the component may be machined or molded, with molding generally more economical when made in larger quantities. Furthermore, the plastics may be the same or different from each other; providing materials of similar chemistry can be used to improve bonding between parts. Alternatively, contact carrier 62 can be made of elastomer to create a compliant male contact assembly 60 which will later be inserted into the male overmold 70 shown in FIG. 6. Making the male contact assembly 60 compliant allows it to act as a spring, thereby eliminating the need for a separate spring 20, which spring will be described later with respect to FIG. 9-12.

Figure 6:
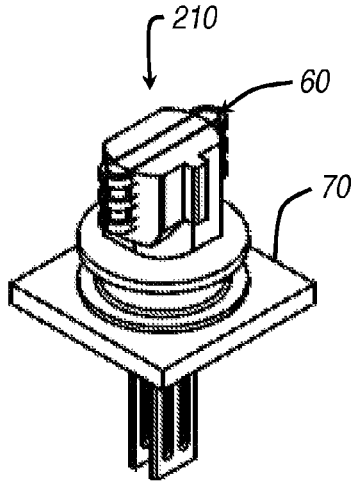
FIG. 6 shows the overmold of the male contact assembly to form a connector cam.

As shown in FIG. 6, male contact assembly 60 is provided with an "overmold" 70 to form a connector cam 210. Overmold 70 can be molded using various plastics forming processes. In an illustrative embodiment, overmold 70 is made of Ultem® 1000 plastic. Providing the materials of overmold 70 similar in chemistry to the material of contact carrier 62 can help ensure good bonding between them. Although not shown, overmold 70 may have a chamfer at the leading edge to aid insertion into the female connector. Alternatively, instead of overmolding male contact assembly 60 with overmold 70, the male contact assembly 60 may be inserted into a separately manufactured overmold 70 which can be machined or molded using various plastics forming processes.

Figure 7:
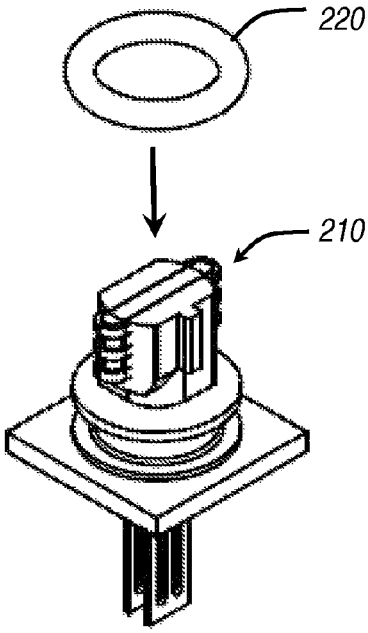
FIG. 7 shows sealing ring assembly onto the connector cam.

As shown in FIG. 7, sealing ring 220 is slid onto connector cam 210. The sealing ring is designed and strategically positioned to fully seal the interface to prevent the introduction of body fluids and other contaminants to the active electrical connection. The sealing ring may be removable for replacement. For purposes of illustration, the sealing ring is shown to reside in a circular groove; however, other sealing ring and groove shapes, cross sections, and configurations can be used. Alternatively, the sealing ring 220 may remain in place by friction without residing in a groove. As another alternative, the sealing ring may be adhered to the connector cam 210, such as by insert molding or adhesive bonding. In yet another alternative embodiment, the sealing ring 220 may be located within the female contact, adhered or within an optional groove (not shown).

Figure 8:
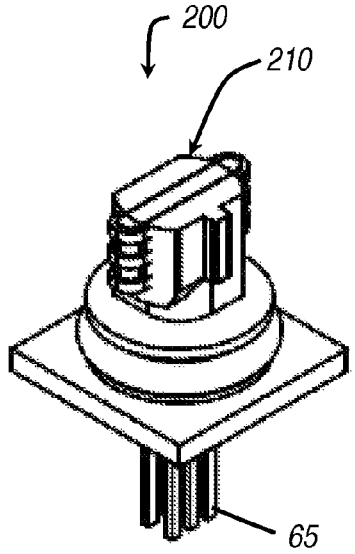
FIG. 8 shows trimmed leads of the connector cam to complete the male connector.

As shown in FIG. 8, leads 65 of the connector cam 210 are trimmed to complete assembly of male connector 200.

Figure 9:
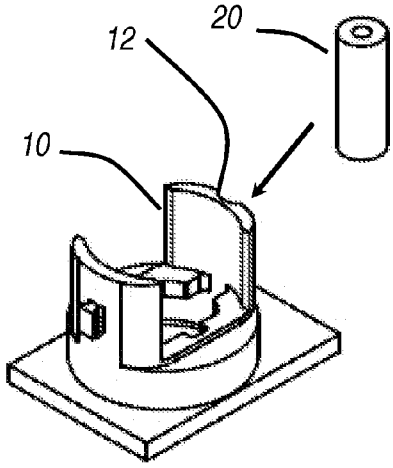
FIG. 9 shows adhesion of a spring to a flex circuit contact mount.

FIGS. 9-12 illustrate assembly of the female connector 100. As shown in FIG. 9, a spring 20 is adhered to a dimple 12 of a flex circuit contact mount 10. The flex circuit contact mount 10 can be machined or molded using various plastics forming processes. In one illustrative embodiment, flex circuit contact mount 10 is made of Ultem® 1000 plastic. The spring 20 may comprise an elastomeric tube, such as silicone rubber, or can be cylindrical, rectangular, or any other suitable geometry. Alternatively, the spring may be of any type of spring, such as a leaf spring, or may comprise multiple separate springs along the width and/or length of the flex circuit 30. Alternatively, a separate spring 20 is not needed if contact carrier 62 is made of elastomer to act as a spring. Alternatively or additionally, cam contacts 64 themselves can be configured to act as a spring, obviating the need for a separate spring 20. Alternatively or additionally, flex circuit contact mount 10 or the flex circuit 30 itself may be configured to provide the desired biasing properties, by geometry, material, or both, obviating the need for a separate spring 20. For example, flex circuit 30 may have a bellows, pleated, or rippled geometry with contacts shaped to accommodate stretching of the overall flex circuit. For example, flex circuit 30 may comprise serpentine contacts on a stretchable substrate as taught in US Patent Application Publication 2009/0317639, which is incorporated herein by reference. As another example, flex circuit 30 may comprise a stretchable electronic device made according to one or more of the teachings of U.S. Pat. Nos. 7,557,367; 7,521,292; and 7,622,367; and US Patent Application Publications 2010/0002402 and 2010/0059863, which are incorporated herein by reference.

Figure 10:
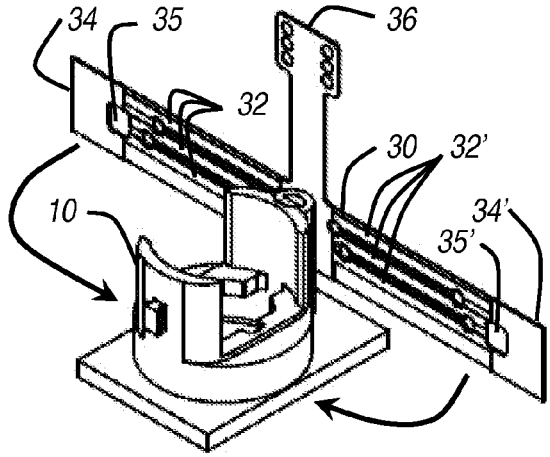
FIG. 10 shows wrapping of the flex circuit around the flex circuit contact mount to form a female contact assembly.
Figure 11:
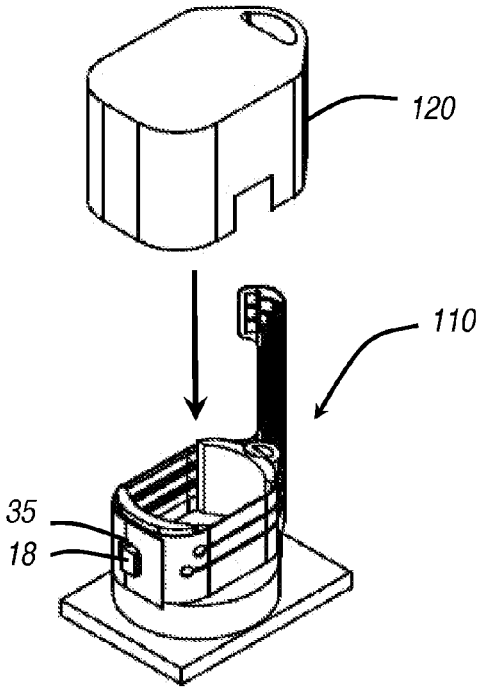
FIG. 11 shows installation of a moisture barrier cap onto the female contact assembly.

As shown in FIG. 10, flex circuit 30 comprising a plurality of flex circuit contacts 32 and 32' is wrapped around the perimeter of flex circuit contact mount 10 and secured thereto to form female contact assembly 110 shown in FIG. 11. The flex circuit contacts are arranged to form at least one group of contacts spaced along the axis of the connector, with the axis being in the same direction as the arrow shown in FIG. 11. The flex circuit contacts may comprise two sets of axially-spaced, parallel, linear contacts, as illustrated. Note that in this illustrative embodiment, for each flex circuit contact 32 there is a corresponding contact 32' that is radially spaced about the axis. Alternatively, the contacts may be arranged in other configurations having one or more groups of axially-spaced contacts, as will be described later with respect to FIGS. 21A-23, or having only radially-spaced contacts. This inventive connector lends itself to many different possibilities, including various layouts of the flex circuit contacts. Although the camming connector invention could be carried out without using a flex circuit, such as by using wire or other metal contacts affixed to a supporting structure, using flex circuit facilitates many different layouts of the contacts, permits consistent manufacturing tolerances for contact placement and alignment, and holds them reliably spaced with respect to each other, allowing many contacts to be used in a small space. The flex contacts may have different lengths, with the camming contacts engaging one flex contact before the rest, thereby allowing one contact, such as a ground, to be electrically connected before the rest. The contacts may even be positioned and configured such that the axial rotation allows contacts to be switched on and off in a particular order, with the cam contacts making and breaking contact with the flex circuit contacts as the connector is rotated.

The flex circuit 30 may comprise side tabs 34 and 34' having cut outs 35 and 35' formed therein for securing to a mounting post 18 on the flex circuit contact mount 10. Although a single mounting post is illustrated, there may alternatively be a separate mounting post for each side tab 34 and 34' at the ends of the flex circuit 30. Alternatively, other attachment methods are possible. While flex circuit 30 is illustrated as having two side tabs 34 and 34' whose flex circuits 32 and 32' take right angle turns to terminal on a single center tab 36, many other configurations are possible. The illustrative embodiment provides for two sets of contacts while requiring only a single feedthrough 122 (FIG. 12) for center tab 36 to pass.

Figure 12:
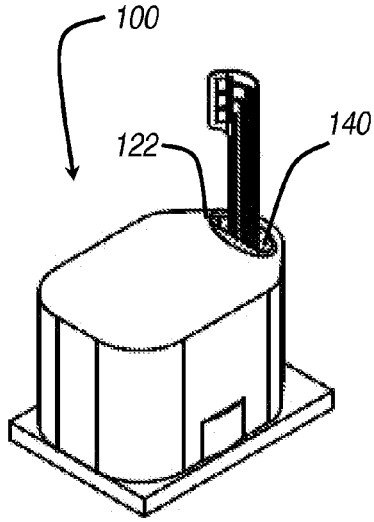
FIG. 12 shows epoxy filling the flex circuit contact feedthrough of the female connector.

As shown in FIG. 11, a moisture barrier cap 120 is assembled onto female contact assembly 110 and adhered to it as shown in FIG. 12. The moisture barrier cap 120 can be machined or molded using various plastics forming processes. In an illustrative embodiment, the moisture barrier cap 120 is made of Ultem® 1000 plastic.

As shown in FIG. 12, the flex circuit contact feedthrough 122 of the female contact assembly 110 is sealed with epoxy 140 to complete assembly of female connector 100.

Figure 13:
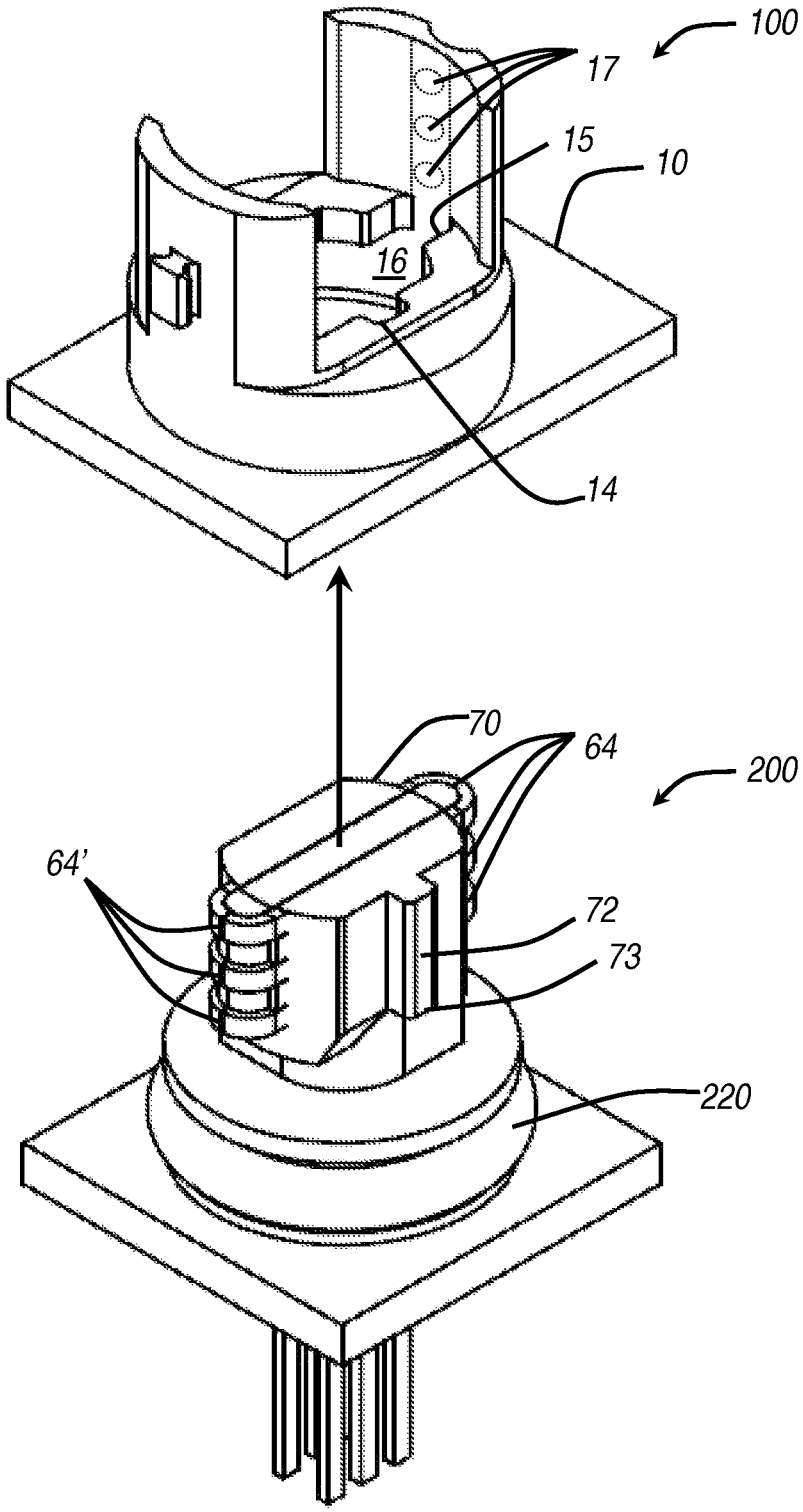
FIG. 13 shows lock features of the female connector and key features of the male connector.
Figure 14:
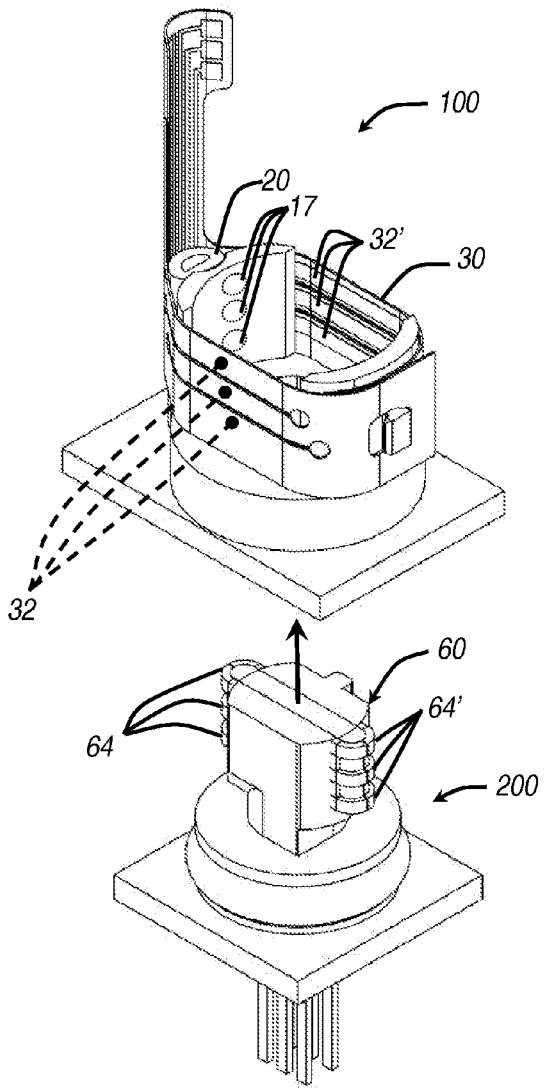
FIG. 14 shows camming features of the female connector and male connector with the connectors disengaged.
Figure 15A:
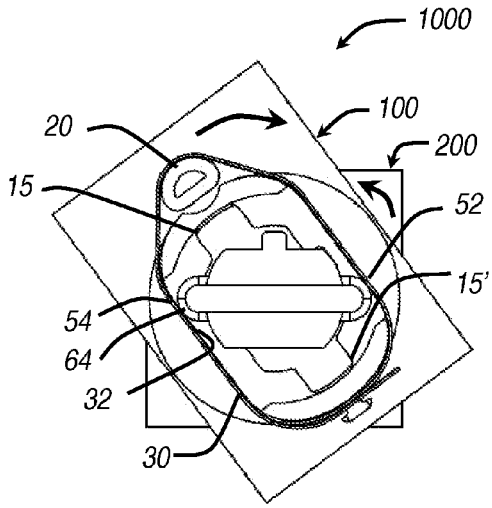
FIGS. 15A and 15B are top and side perspective views, respectively, of the camming contact of FIG. 14 as engaged.

FIG. 13 shows lock features of the female connector 100 (shown without the flex circuit and moisture barrier cap) and key features of the male connector 200. The flex circuit contact mount 10 of the female connector has a keyway 14 formed therein, and the overmold 70 of the male connector has a matching key 72. When the male and female connectors are oriented such that the key 72 is aligned with the keyway 14, the connectors can be pushed together in the axial direction of the connectors, as indicated by the arrow. Once the parts have slid far enough so that the bottom 73 of the key 72 has traveled past the edge of the keyway 14, the cam contacts 64 land on or near cam contact landings 17 on the inner surface of flex circuit contact mount 10. When the connectors are have been thus pushed together, the sealing ring 220 of the male connector 200 is in sealing contact with an inner sealing surface 16 of the flex circuit contact mount 10 of the female connector, reliably sealing the connectors against moisture, and providing a frictional engagement with the inner sealing surface 16 to stabilize the connectors. The connectors can then be rotated with respect to each other such that the key and keyway are no longer aligned, locking them in place and preventing them from being pulled apart. As the connectors are rotated with respect to each other, as shown in FIGS. 14, 15, and 15A, the cam contacts 64 and 64' contact the flex circuit contacts 32 and 32'. The frictional engagement of the sealing ring 220 with the sealing surface 16 also prevents the connectors from inadvertently rotating with respect to each other. Thus, sealing, translational stabilization, translational locking, contact, and rotational stabilization are accomplished in one motion, simply by inserting the male connector into the female connector and twisting. Alternatively, detents, magnets and other methods of stabilizing the connector in rotation and translation are possible.

Alternatively, although not illustrated, cam contacts 64 on a first side of the male connector 200 may be differently shaped from cam contacts 64' on the other side. The cam contact keyway 15 on one side of the flex circuit contact mount 10 may be shaped to allow cam contacts 64 but not cam contacts 64' to slide through it. Additionally or alternatively, a cam contact keyway 15' on the opposite side (shown in FIG. 15A) may be shaped to allow cam contacts 64' but not cam contacts 64 to slide through it. This eliminates the need for a separate keyway 14 and key 72.

Alternative sealing mechanisms to the sealing ring 220 may be used. For example, an elastomeric washer may be placed between the bottom of the flex circuit contact mount 10 and the mating surface of the male overmold 70. This elastomeric washer is dimensioned to have an interference fit such that when the connectors are pushed against each other and rotated, the connectors frictionally engage the washer so that they cannot be inadvertently rotated apart. Although slightly longer to allow for the thickness of the washer, this washer-type seal allows the overall connector to be narrower than for the sealing ring type.

FIG. 14 shows the camming contact of the female connector 100 (shown without the moisture barrier cap) and the male connector 200. The flex circuit 30 of the female connector 100 has multiple flex circuit contacts 32 and 32', with six (three on each side) shown here for illustration purposes. The male contact assembly 60 has multiple fixed metal cam contacts 64 and 64' for coupling to the flex circuit contacts 32 and 32'. Again, six, where on each side, are shown for illustration purposes and to correspond to the six flex circuit contacts. Optionally, insulating barriers may be provided between the flex circuit contacts or between the cam contacts, or both. These barriers may also aid in alignment of the contacts, and may be especially advantageous for high-contact count connections. These optional barriers may also be configured to provide added stabilization and prevent rotation that might tend to inadvertently disconnect the connectors.

Note that during the insertion of male connector 200 into female connector 100, no part of the male connector contacts the flex circuit contacts 32. This prevents damage to the flex circuit contacts 32 that might otherwise occur if a portion of the male connector, such as cam contacts 64, were allowed to scrape against the flex circuit contacts 32 during insertion. It is not until the male connector is fully inserted into the female connector that they can rotate with respect to each other such that cam contacts 64 contact flex circuit contacts 32.

Figure 15B:
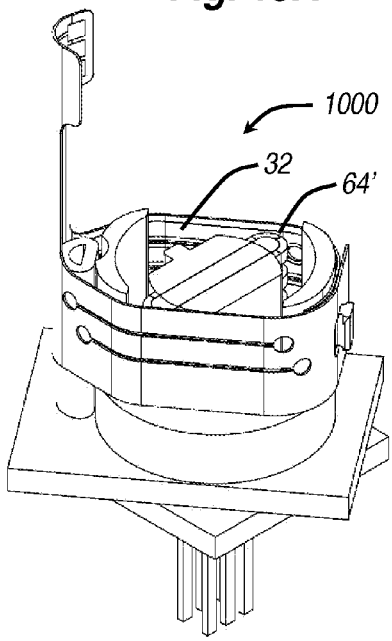

FIGS. 15A and 15B are top and side perspective views, respectively, of the multi-contact connector system 1000 with female connector 100 engaged and rotated in the direction of the arrow with respect to the male connector 200. The moisture barrier cap is not shown. The cam contacts 64 are shown coupled to the flex circuit contacts 32 at two camming contact locations, 52 and 54. The locations where the cam contacts 64 couple to the flex circuit contacts 32 change as the female connector 100 is rotated with respect to the male connector 200. The spring 20 ensures that the flex circuit 30 remains in tight, stable electrical and mechanical connection with the cam contacts 64 at a wide range of degrees of rotation.

Figure 16:
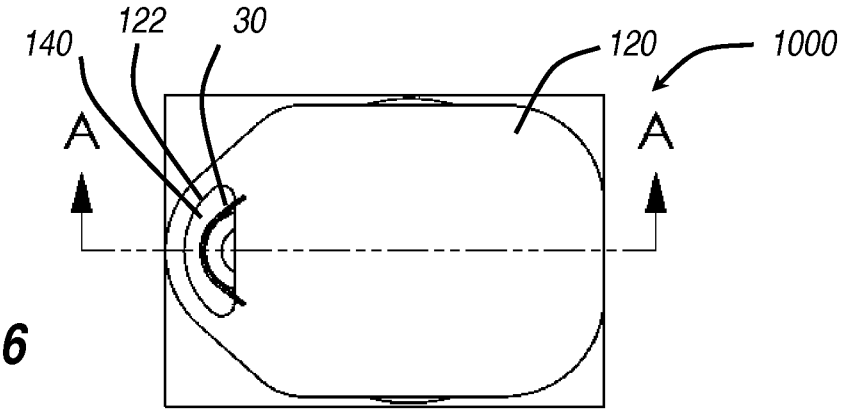
FIGS. 16 and 16A show top view and side cross section view, respectively, of the multi-contact connector system of the present invention.
Figure 16A:
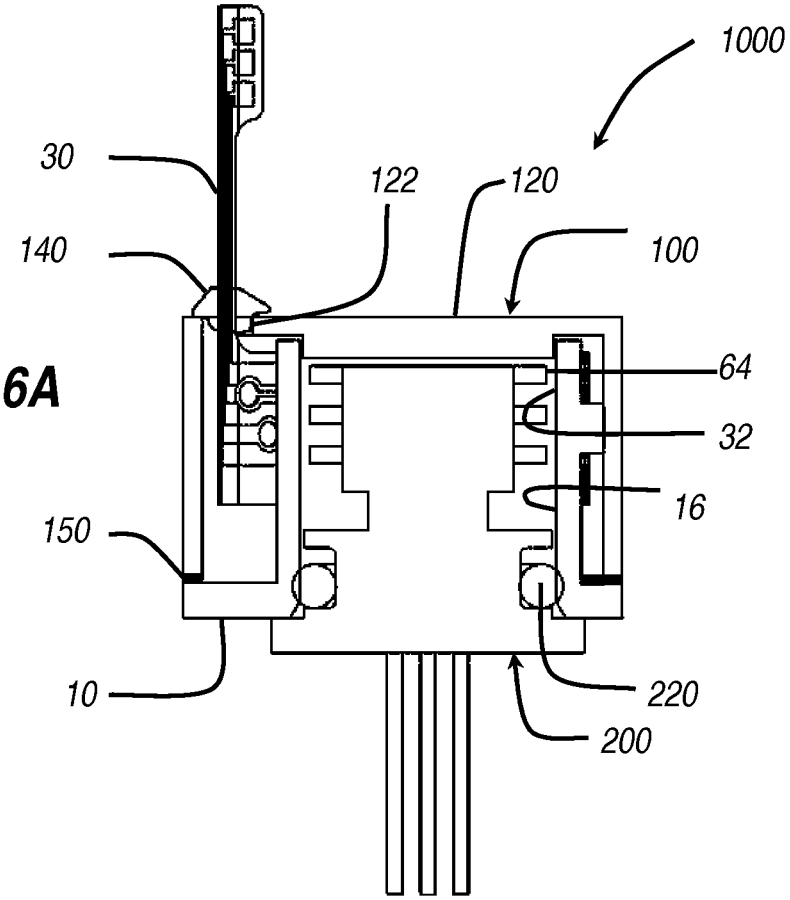

FIGS. 16 and 16A show top and side cross sectional views, respectively, of the multi-contact connector system 1000 of the present invention, illustrating the sealing features for moisture proofing. The moisture barrier cap 120 has a flex circuit contact feedthrough 122 formed therein through which flex circuit 30 extends from the inside to the outside of the moisture barrier cap. The flex circuit contact feedthrough 122 is sealed with epoxy 140 to prevent moisture leakage therethrough. In addition, an adhesive seal 150 is formed between the moisture barrier cap 120 and the female flex circuit mount 10 to prevent moisture leakage at that junction. Furthermore, when the multi-contact connector system 1000 is fully assembled with the female connector 100 engaged with the male connector 200, the sealing ring 220 of the male connector is in sealing contact with the inner sealing surface 16 of the flex circuit contact mount 10 of the female connector, thereby preventing moisture leakage to the cam contacts 64 and flex circuit contacts 32.

Figure 17A:
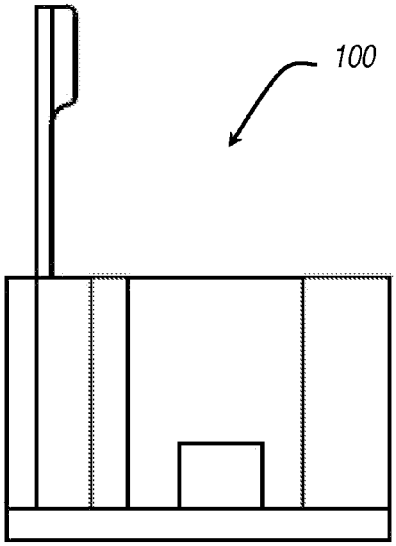
FIGS. 17A and 17B show side and front views of the female connector.
Figure 17B:
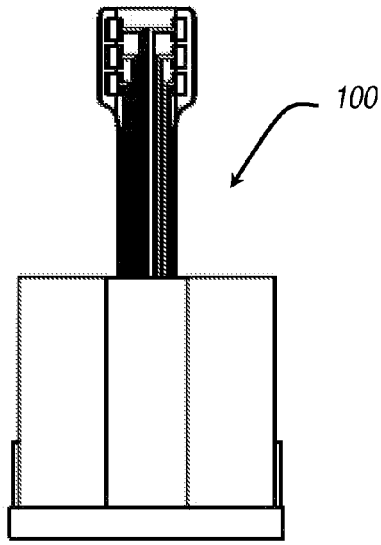

FIGS. 17A and 17B show side and front views of the female connector 100.

Figure 18A:
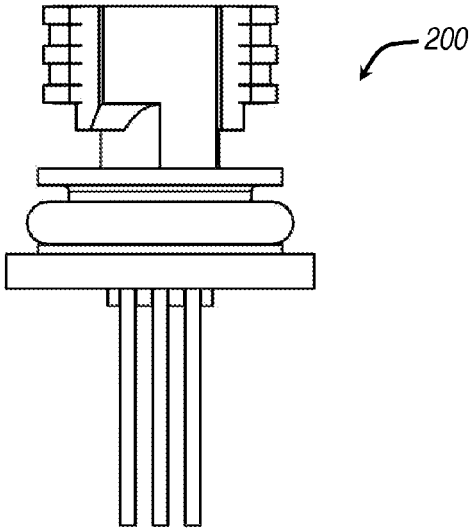
FIGS. 18A and 18B show side and front views of the male connector.
Figure 18B:
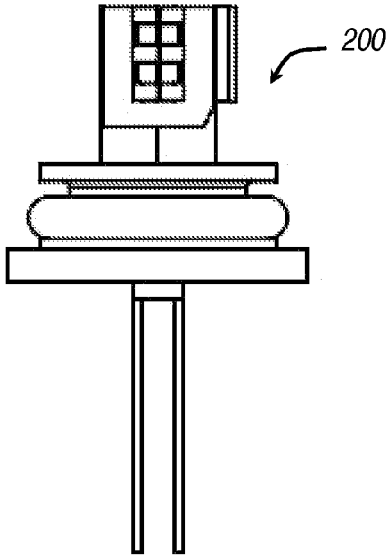

FIGS. 18A and 18B show side and front views of the male connector 200.

Figure 19A:
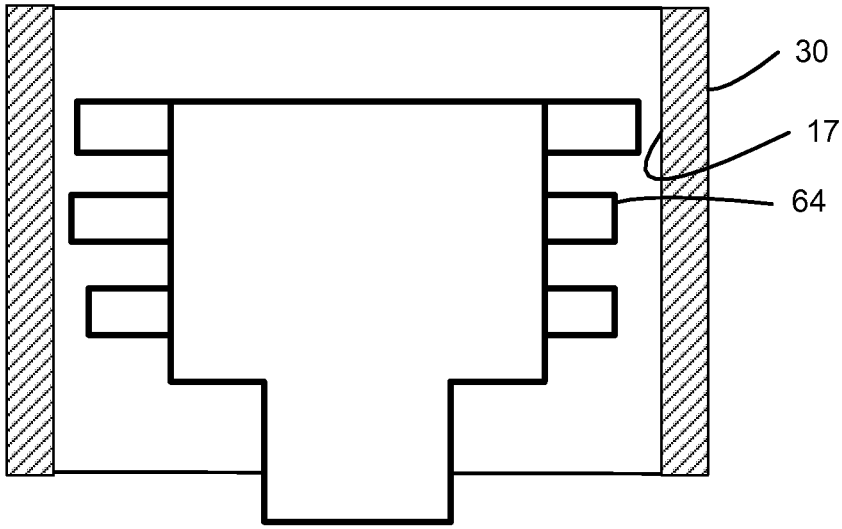
FIGS. 19A and 19B illustrate the no contact state and rotated contacting state between the cam contacts and the flex circuit contacts, respectively.
Figure 19B:
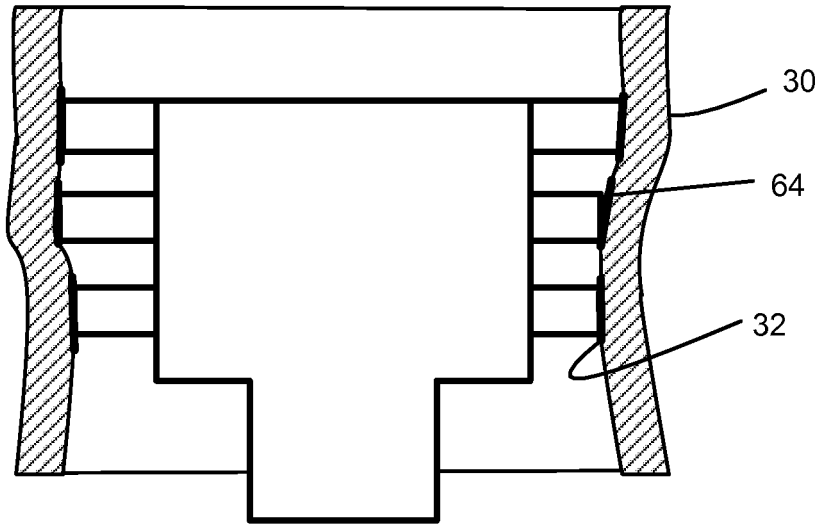
Figure 20:
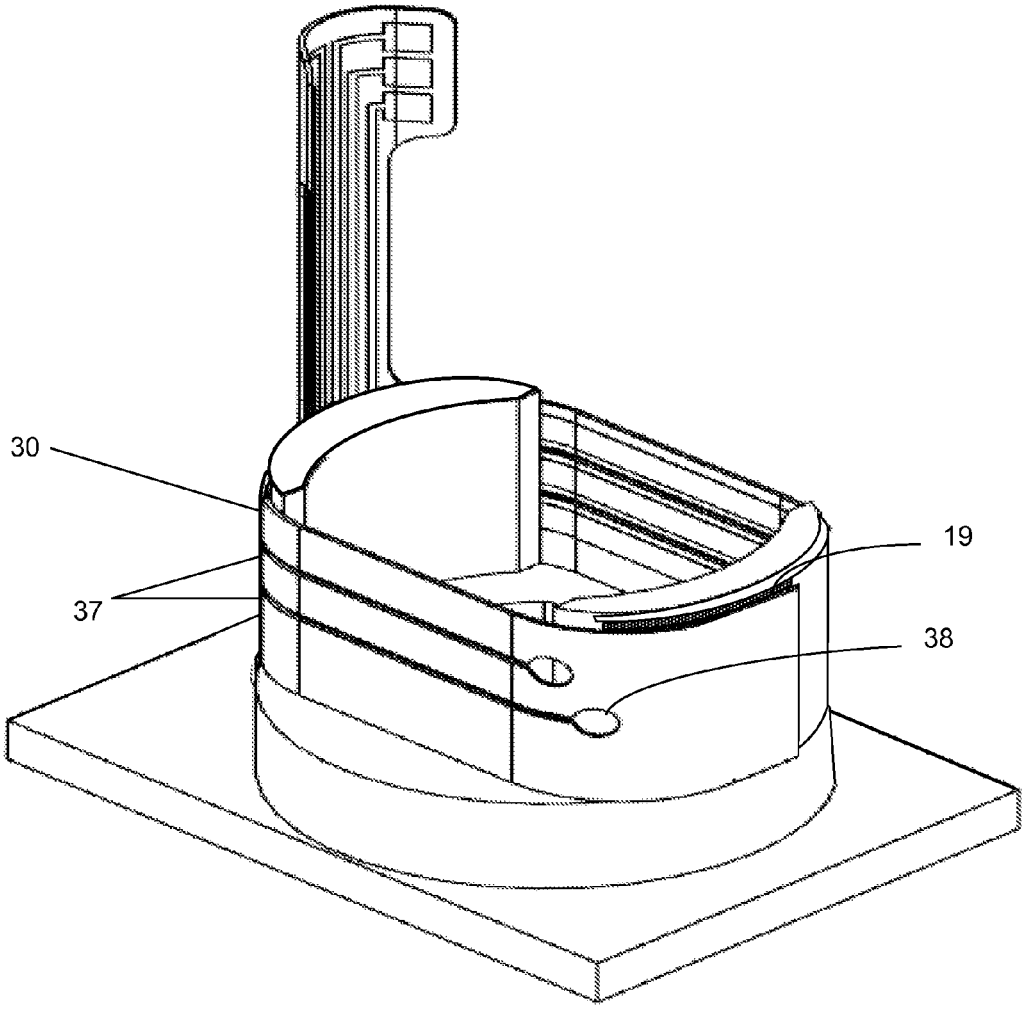
FIG. 20 illustrates an alternative embodiment of the invention.

FIGS. 19A and 19B are side cross-sectional views illustrating the contact between the cam contacts 64 and the flex circuit contacts 32. FIG. 19A shows the cam contacts 64 aligned with landings 17 on flex circuit 30, but not yet rotated to contact the flex circuit contacts. Cam contacts 64 are shown as not perfectly aligned with each other, illustrating manufacturing variations that typically can be expected in real world parts. As shown in FIG. 19B, flex circuit contacts 32 reliably make contact with cam contacts 64 because the flex circuit 30 conforms to the actual location of the cam contacts. This can be achieved in several ways. The flex circuit 30 is flexible and is put in tension around cam contacts 64. Flexibility of the flex circuit 30 in the proximity of the contact site can be increased using a flex circuit slit 37 between neighboring cam contacts 64, as shown in FIG. 20. Stress concentrations at both ends of each flex circuit slit 37 can be reduced using stress slit holes 38 in the shape of a circle, tear drop or alternative geometry. As described above, one way this tension may be maintained is by use of an elastomeric spring 20, as shown in FIGS. 15A and 15B. Alternatively, as described above, contact carrier 62 (shown in FIG. 5) can be made of elastomer to create a compliant male contact assembly 60 (FIG. 6), allowing it to act as a spring for keeping cam contacts 64 engaged with the flex circuit contacts 32. Yet another way is as shown in FIG. 20, using a flexible adhesive 19, such as RP Series 3M™ VHB™ Foam Tape, to join the two ends of the flex circuit 30 together and to act as a spring so that a separate spring 20 shown in FIG. 14 is not needed. The minimum functional attributes of the flexible adhesive 19 is such that the bonding shear strength is sufficient to withstand tension in the flex circuit, and shear strain allows sufficient deflection of the flex circuit in assembly and use. The shear modulus of the flexible adhesive 19 will determine the tension in the flex circuit 30.

Figure 21A:
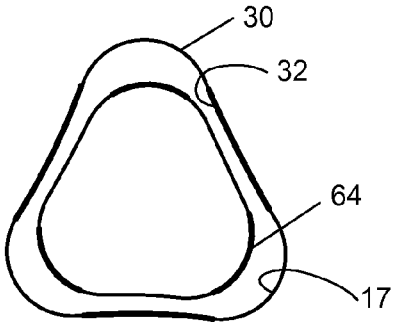
FIGS. 21A, 21B, 22A, and 22B illustrate alternative embodiments of the invention.
Figure 22A:
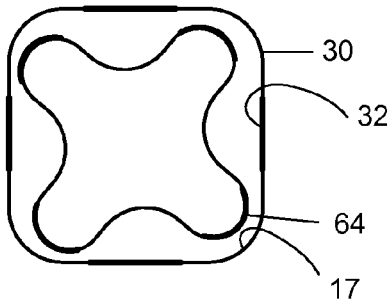
Figure 21B:
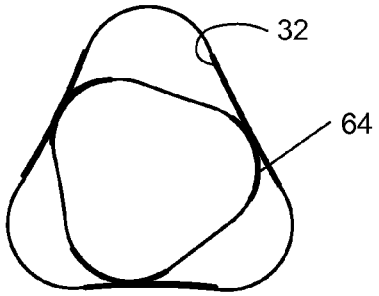
Figure 22B:
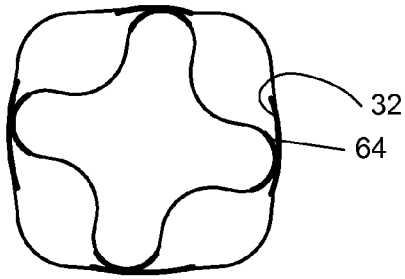

FIGS. 21A and 22A are simplified top views of an alternative embodiment of the present invention, showing portions of a male connector showing cam contacts 64 and a female connector showing flex circuit contacts 32, wherein cam contacts 64 are aligned with landings 17 on flex circuit 30, but not yet rotated to contact the flex circuit contacts. While the embodiment shown in FIG. 15A has two sets of cam contacts 64 and 64' and two sets of flex circuit contacts 32 and 32', that of FIG. 21A has three sets of each, and that of FIG. 22A has four sets of each. Alternatively, although not illustrated, the connectors may contain only one set or five or more sets of contacts. Furthermore, the number of contacts in each set is not limited. While most of the figures herein, such as 19B, show two sets of three contacts in each set, each set may alternatively contain one, two, or more than three contacts, and also need not necessarily contain the same number of contacts in each set. Furthermore, the male connector need not contain the same number of contacts as the female contact. As an example, in a device requiring a connector with five contacts for various functions, to keep the structure symmetrical, two sets of three cam contacts 64 may be provided on the male connector, whereas the female connector may have only five flex circuit contacts 32. FIGS. 21B and 22B show the connectors of FIGS. 21A and 22A, respectively, with the male connector rotated with respect to the female connector such that the cam contacts 64 make electrical and mechanical contact with flex circuit contacts 32. Note that the embodiments of FIGS. 21A-21B and 22A-22B may be configured with only one contact per "set," such that contacts are all radially spaced about the axis but not axially spaced, to provide a very low profile connector having three and four contacts, respectively, which would be sufficient for many applications.

Figure 23:
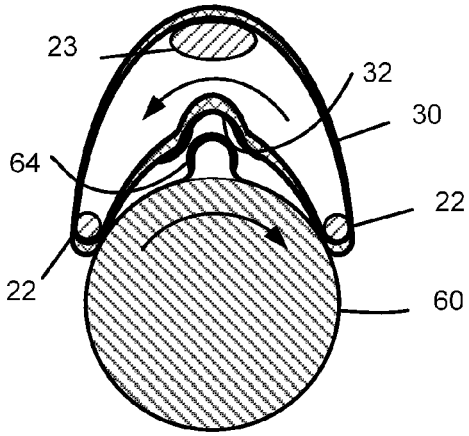
FIG. 23 illustrates another alternative embodiment of the invention.

FIG. 23 illustrates another alternative embodiment having only one set of cam contacts 64 and only one set of flex circuit contacts 32. In this embodiment, the flex circuit 30 is held in tension around a flex circuit contact mount comprising several posts, such as circular posts 22 and elliptical post 23. Flex circuit 30 may comprise material that is flexible due to geometry, material elasticity, or both, as described earlier, and be placed in tension around posts 22 and 23; alternatively one of the posts, such as post 23, may comprise elastomeric material and act like spring 20 of previously-described embodiments. Contact assembly 60 is inserted with its cam contacts 64 alongside flex circuit contacts 32 of flex circuit 30 and then rotated as shown by the arrow to bring the cam contacts into contact with flex circuit contacts. Notice that in this embodiment, the connector bearing the cam contacts is inserted alongside, not interior to, the wrapped flex circuit.

Figure 24A:
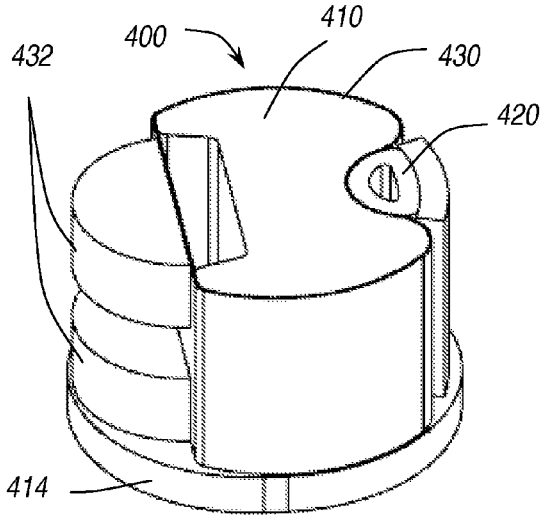
FIG. 24A-24D illustrate another alternative embodiment of the invention.
Figure 24C:
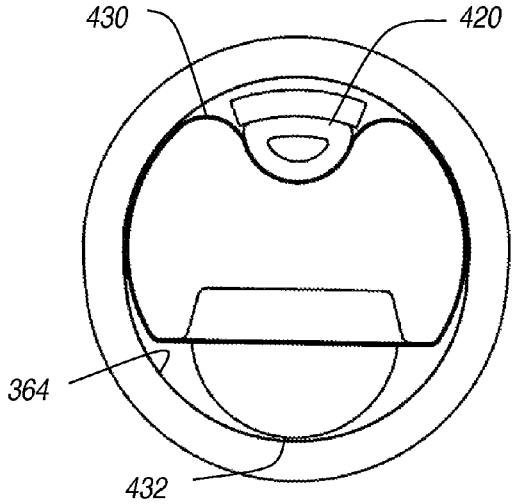
Figure 24B:
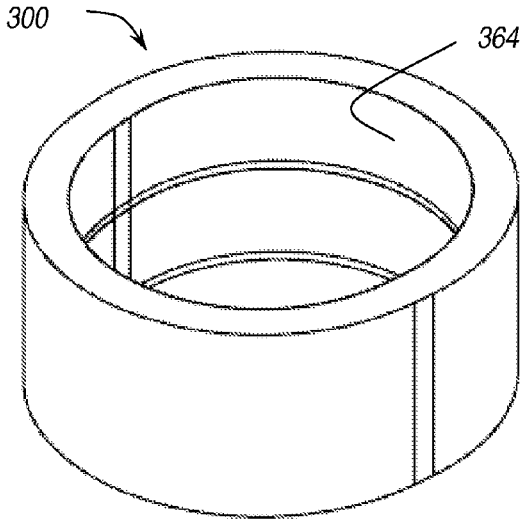
Figure 24D:
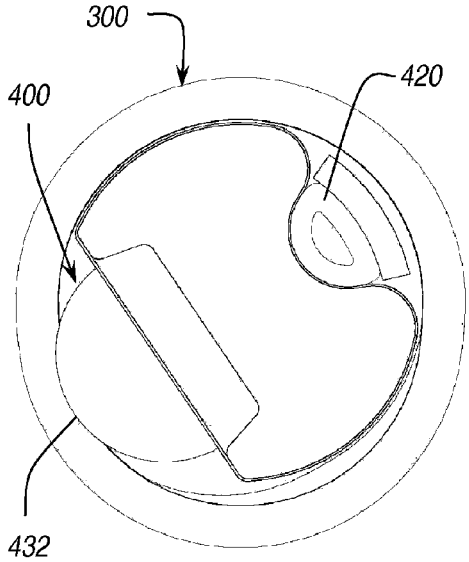

In an alternative embodiment illustrated in FIG. 24A-24D, male connector 400 includes a flex circuit 430, held in tension by flex circuit carrier 410, and an elastomeric spring 420 that tends to bias the male connector contacts 432 against the female connector contacts 364 on the female connector 300 when the connectors are in their operating orientation. The female connector 300 is relatively rigid and is noncircular. The male contacts 432 may be part of the flex circuit 430 or may be mounted on the circuit or other flexible plastic. A flange 414 may be keyed (not shown) to provide polarity and locking functions in a similar manner as the various keys described above. FIG. 24D shows the cam action of the male connector 400 as it is rotated clockwise with respect to the noncircular female connector 300 to make contact of the male connector contacts 432 with the female connector contacts 364. It should be noted that in the illustrative embodiments thus far described, rotation of the one connector with respect to the other to cause camming engagement of the flex circuit causes additional tensile force to be applied to the flex circuit.

Figure 25A:
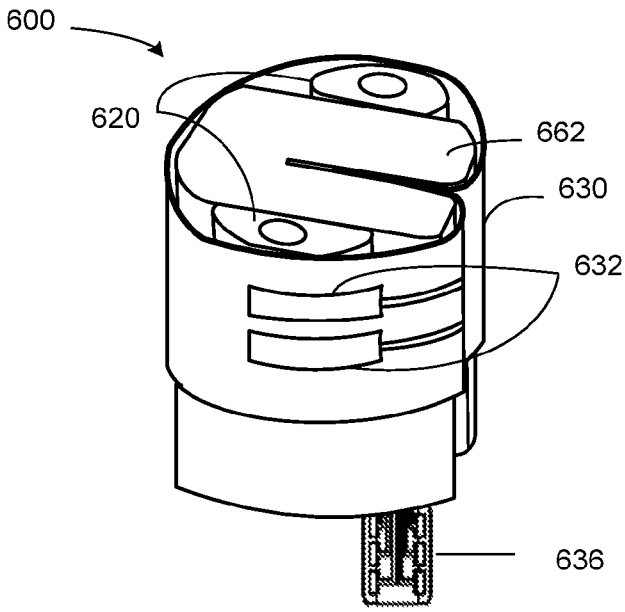
FIG. 25A-25C illustrate yet another alternative embodiment of the invention.
Figure 25B:
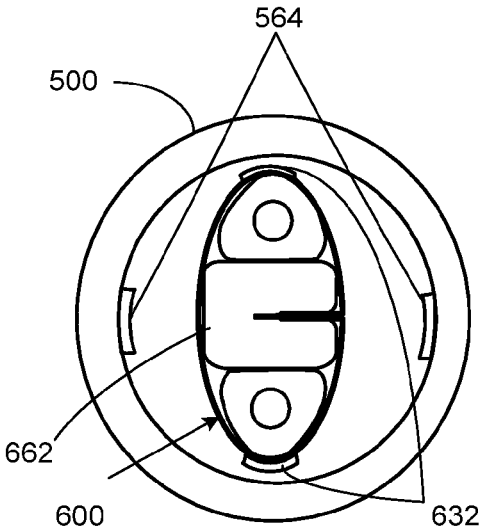
Figure 25C:
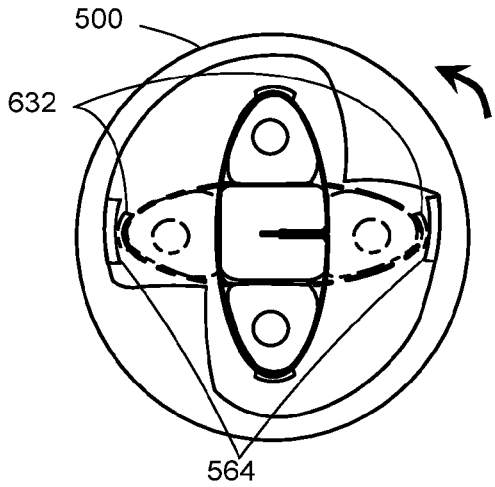

In yet another alternative embodiment illustrated in FIG. 25A-25C, a male connector 600 comprises a flex circuit 630 surrounding a carrier 662 having one or more elastomeric springs 620 (two shown). The flex circuit 630 has flex circuit contacts 632 and is captured in a flex capture feature, which may be located in the carrier 662. As shown in FIGS. 25B and 25C, the male connector 600 is inserted into a rigid, noncircular female connector body having fixed contacts 564, and then rotated to engage the male connector contacts 632 with the female connector contacts. It should be noted that for the embodiment in FIG. 25A-25C unlike in the illustrative embodiments described previously, rotation of the one connector with respect to the other to cause camming engagement of the flex circuit does not rely on the development of tensile force in the flex circuit. The contacts on the flex circuit 630 may be oriented as in some of the previously-described embodiments, such that they are axially spaced and parallel to each other, with traces that take a right angle so that they can be brought out from the connector on a tab 636 of the flex circuit through a feedthrough. FIGS. 25B and 25C illustrate two different shapes for the interior of the housing of the female connector 500. In one embodiment, the interior is oval or elliptical. In a second illustrative embodiment, the shape allows rotation of the male connector in one direction only and has a positive stop to provide tactile feedback that the connector has been rotated into the operating position with the contacts engaged. The male connector 600 is inserted into the female connector 500 in an insertion orientation, and then rotated to an operating position in which the male contacts 632 contact the female contacts 564.

Although not shown, the embodiments of 20, 21A-21B, 22A-22B, 23, 24A-24D, and 25A-25C may include the locking and sealing features shown and described for other embodiments.

While the connector of the present invention has been described in detail in the context of its application to a BTE sound processor for an implantable cochlear system, it is to be understood that a connector in accordance with the present invention also has utility to any application having similar requirements. For example, the present invention may be used for other medical devices, such as conventional BTE hearing aids, which have a similar problem of sweat adversely affecting the battery and electronics. The advances set forth herein may also be used outside the field of medical devices. For example, the present invention can be used for military and police applications, such as for personal communication devices. Rather than carry around cumbersome walkie-talkies, a simple external, ear-mounted device can be used, utilizing the multi-contact connector system of the present invention to connect batteries and accessories. The present invention may also be used for portable computer and Internet hand-held device systems, and for personal entertainment devices that require a seal protection and mechanical stability. Furthermore, for some applications, the connection need not be moisture resistant, thereby eliminating the need for some of the sealing features, such as the sealing ring and its attendant groove and sealing ring surface on the mating connector, and the moisture barrier cover and its attendant epoxy and adhesive seals, thereby allowing for a more compact and less expensive multi-contact connection system. Such non-moisture resistant applications may include, for example, non-ear-level (e.g., body-worn) sound processors. All of these other applications are intended to come within the scope of the present invention.

While the invention herein disclosed has been described by means of specific embodiments and applications thereof, numerous modifications and variations could be made thereto by those skilled in the art without departing from the scope of the invention set forth in the claims.

What is claimed is:

1. A multi-contact connector system for connecting an auxiliary device to an electronic device, comprising:

a first connector having a first longitudinal axis and including a plurality of first contacts spaced apart from each other on a flex circuit that forms a loop which defines an open region and extends around the first longitudinal axis;

a second connector having a second longitudinal axis and including a cam having a plurality of second contacts; wherein one of the connectors is configured to be plugged into the other connector from a starting position to a translated position where the cam and second contacts are located within the open region of the loop formed by the flex circuit; and wherein the second connector is configured to be rotatable with respect to the first connector, from the translated position to a rotated position, to force at least some of the plurality of second contacts on the cam into electrical and mechanical contact with corresponding ones of the plurality of first contacts on the flex circuit.

2. The connector system of claim 1 wherein at least two of the first contacts are spaced apart from each other along the first longitudinal axis.

3. The connector system of claim 1 wherein at least two of the first contacts are spaced apart from each other radially about the first longitudinal axis.

4. The connector system of claim 1 wherein at least two of the first contacts are linear and arranged parallel to each other.

5. The connector system of claim 1 wherein at least two of the second contacts are spaced apart from each other along the second longitudinal axis.

6. The connector system of claim 1 wherein at least two of the second contacts are spaced apart from each other radially about the second longitudinal axis.

7. The connector system of claim 1 wherein at least two of the second contacts are linear and arranged parallel to each other.

8. The connector system of claim 1, wherein the connectors are configured such that when the one connector is plugged into the other connector from a starting position to a translated position, at least one second contact passes at least one first contact without the second contacts contacting the first contacts.

9. The connector system of claim 1, wherein the first connector further comprises a flex circuit contact mount and wherein the flex circuit is mounted on the flex circuit contact mount.

10. The connector system of claim 9, wherein the flex circuit contact mount maintains the flex circuit in tension.

11. The connector system of claim 9, wherein the first connector comprises a spring biasing the first contacts against the second contacts.

12. The connector system of claim 1, wherein the second connector further comprises a contact carrier on which the second contacts are carried, wherein the contact carrier is configured to act as a spring biasing the second contacts against the first contacts.

13. The connector system of claim 1, further comprising a key on one of the connectors and a keyway on the other of the connectors configured to disallow translation when the key is misaligned with the keyway, to allow translation from the starting position to the translated position when the key is aligned with the keyway, to disallow rotation when in a position intermediate the starting position and the translated position, to allow rotation from the translated position to the rotated position, and to disallow translation to separate the connectors when in the rotated position.

14. The connector system of claim 1, wherein the first connector further includes a moisture barrier cap enclosing the first contacts and having a first contact feedthrough formed therein.

15. The connector system of claim 1, wherein at least one of the first connector and the second connector further comprises a seal for forming a seal between the first connector and the second connector, thereby preventing moisture from reaching the second contacts and the first contacts.

16. The connector system of claim 1, wherein the electronic device is a Behind-The-Ear (BTE) device and the auxiliary device is an earhook.

17. The connector system of claim 1, wherein the electronic device is a hearing device and the auxiliary device is a power source.

18. The connector system of claim 1, wherein the electronic device is a hearing device and the auxiliary device is capable of transmitting or receiving information.

19. A method for making a connector system, comprising the steps of:

providing a first connector comprising a plurality of first contacts spaced apart from each other by providing a flex circuit having a plurality of first contacts arranged thereon, providing a flex circuit contact mount having a keyway formed therein, wrapping the flex circuit around the flex circuit contact mount, and securing the flex circuit to the flex circuit contact mount; and placing a plurality of second contacts onto a contact carrier to form a second connector, configured to rotate with respect to the first connector and force at least one of the second contacts into electrical and mechanical contact with at least one of the first contacts.

20. The method of claim 19, further comprising the step of installing a sealing ring onto at least one of the connectors.

21. A method for making an electro-mechanical connection, comprising the steps of:

providing a first connector having an axis and including a flex circuit, having an inwardly facing first side and an outwardly facing second side and a plurality of first contacts on the first side spaced apart from each other along the axis, that is held in tension with the plurality of first contacts facing inwardly;

providing a second connector including a plurality of second contacts facing outwardly;

pushing the connectors together such that the second contacts are located within a volume defined by the flex circuit; and rotating the second connector with respect to the first connector such that at least one of the outwardly facing second contacts electrically and mechanically makes contact with a corresponding one of the inwardly facing first contacts.

22. The method of claim 21, wherein the step of providing the first connector comprises providing a resilient structure that tensions the flex circuit.

* * * * *